US011191337B2

(12) United States Patent
Albisetti

(10) Patent No.: US 11,191,337 B2
(45) Date of Patent: Dec. 7, 2021

(54) DEVICE FOR PACKAGING AND APPLYING A PRODUCT, NOTABLY A LIQUID COSMETIC PRODUCT

(71) Applicant: L'Oreal, Paris (FR)

(72) Inventor: Nicolas Albisetti, Saint Ouen (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 16/644,894

(22) PCT Filed: Aug. 22, 2018

(86) PCT No.: PCT/EP2018/072595
§ 371 (c)(1),
(2) Date: Mar. 5, 2020

(87) PCT Pub. No.: WO2019/048229
PCT Pub. Date: Mar. 14, 2019

(65) Prior Publication Data

US 2020/0205548 A1 Jul. 2, 2020

(30) Foreign Application Priority Data

Sep. 5, 2017 (FR) ..... 1758175

(51) Int. Cl.
*B43K 23/08* (2006.01)
*A45D 34/04* (2006.01)

(52) U.S. Cl.
CPC ..... *A45D 34/041* (2013.01); *A45D 2200/051* (2013.01)

(58) Field of Classification Search
CPC .. A45D 34/041; A45D 34/045; A45D 40/261; A45D 40/265
(Continued)

(56) References Cited

U.S. PATENT DOCUMENTS 4,832,060 A 5/1989 Kingsford
5,492,426 A 2/1996 Gueret
(Continued)

FOREIGN PATENT DOCUMENTS

EP 0 688 516 A1 12/1995
JP H06296520 A 10/1994

OTHER PUBLICATIONS

International Search Report dated Oct. 1, 2018, issued in corresponding International Application Mo. PCT/EP2018/072595, filed Aug. 22, 2018, 2 pages.

*Primary Examiner* — Jennifer C Chiang
(74) *Attorney, Agent, or Firm* — Christensen O'Connor Johnson Kindness PLLC

(57) ABSTRACT

The device for packaging and applying a product, notably a liquid cosmetic product, comprises a container delimiting an internal reservoir for storing said the product, and comprising an opening providing access to the reservoir, a closure member mounted removably on the container so as to move between a position in which the container is closed and an open position, and a member for applying the product. The closure member bears the application member. The container internally comprises a narrowing of the section delimiting the opening providing access to the internal reservoir of the container. The application member extends at least in part through the access opening, sealing the said opening closed when the closure member is in the closed position, the application member being situated outside the container when the closure member is in the open position.

12 Claims, 2 Drawing Sheets

Figure 2:
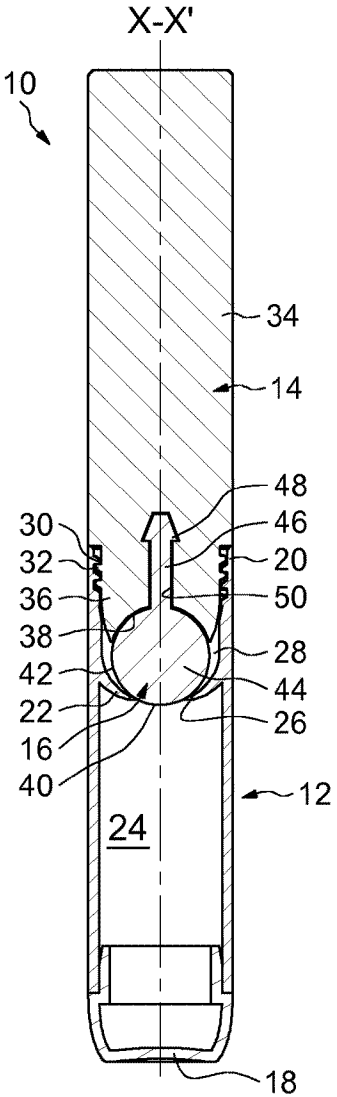

(58) Field of Classification Search
USPC ..... 401/209, 213, 126
See application file for complete search history.

(56) References Cited

U.S. PATENT DOCUMENTS

| | | | | | |
|---|---|---|---|---|---|
| 5,573,340 | A * | 11/1996 | Gueret | ..... | A45D 34/045<br>401/119 |
| 5,720,563 | A | 2/1998 | Nakagawa | | |
| 6,776,549 | B2 * | 8/2004 | Gueret | ..... | A45D 34/042<br>401/126 |
| 6,942,412 | B2 * | 9/2005 | Gueret | ..... | A45D 34/045<br>401/123 |
| 6,945,723 | B1 | 9/2005 | Gueret | | |
| 7,044,670 | B2 * | 5/2006 | Delage | ..... | A45D 34/041<br>401/126 |

* cited by examiner

DEVICE FOR PACKAGING AND APPLYING A PRODUCT, NOTABLY A LIQUID COSMETIC PRODUCT

The present invention relates to a device for packaging and dispensing a product, notably a liquid cosmetic product.

The expression "cosmetic product" is understood to mean any product as defined in Regulation (EC) No 1223/2009 of the European Parliament and of the Council of 30 Nov. 2009 on cosmetic products.

The device is intended more particularly for packaging and dispensing a liquid or fluid cosmetic product that is intended to be applied to a human keratin surface, such as the skin, the lips or the hair.

The development of formulations dedicated to making up and/or caring for the skin and/or lips and/or eyes and/or for haircare, having satisfactory properties in terms of application, of comfort, of wear property and of coverage, but also in terms of make-up effect, such as for example the sheen, is an ongoing objective.

Numerous packaging devices have been developed to enable satisfactory application of fluid or liquid products.

For example, mention may be made of patent U.S. Pat. No. 4,002,411, which describes a packaging and application device of "roll on" type comprising a spherical ball, which is mounted with the freedom to rotate on itself, in a housing surmounting a container containing the product that is to be applied. The housing comprises a first opening for placing a first surface portion of the ball in communication with the product contained in the container, and a second opening, through which a second surface portion of the ball extends, towards the outside.

In order to apply product, the user shakes or inverts the container so as to bring product into contact with the first surface portion of the ball. After detaching a closure cap, the second surface portion of the ball is brought into contact with the surface that is to be treated. Through a suitable movement of the device relative to this surface, the ball is rotated on itself so that the first portion thereof, which is laden with product, is brought into register with the second opening, thus allowing the product to be applied to the surface that is to be treated.

This imposed set of actions for bringing the product-laden surface of the ball into contact with the surface that is to be treated is suitable when the matter is that of applying a product of the body deodorant type.

However, for applying products dedicated to make up and/or skincare, for example products intended for treating the visible signs of ageing and tiredness, such as dark circles and bags around and under the eyes, such a set of user actions does not allow precise application of the product to be achieved.

The present invention aims to remedy this drawback.

The subject of the invention is a device for packaging and applying a product, notably a liquid cosmetic product, comprising a container delimiting an internal reservoir for storing said product, and comprising an opening providing access to the said reservoir, a closure member mounted removably on the container so as to move between a position in which the said container is closed and an open position, and a member for applying the product.

According to a first general feature, the closure member bears the application member.

According to a second general feature, the container internally comprises a narrowing of the section delimiting the opening providing access to the internal reservoir of the said container. The access opening is thus in direct fluidic communication with the reservoir. The access opening is in permanent communication with the reservoir and is not combined with a selective dispensing means of the pump or valve type that makes it possible to force the product to pass through the said opening.

According to a third general feature, the application member extends at least in part through the access opening, sealing the said opening closed when the closure member is in the closed position. The application member is situated outside of the container when the closure member is in the open position.

The application member becomes laden with product by simple shaking, or alternatively by inverting the device such that the container is situated above the closure member. If the container is produced in the form of a tube with a deformable flexible wall, the application member may become laden with product as a result of pressure exerted on this wall.

The fact that the application member seals closed the opening providing access to the reservoir makes it possible to avoid any flow of product out of this reservoir when the application member is being laden with product, even in the case of a product of low viscosity.

After the application member has been laden with product, the closure member is detached from the container so that the said product can be applied. This application may then be performed precisely on the surface that is to be treated so long as the application member is separated from the container. The closure member forms an element via which the application member is grasped.

Furthermore, the fact that the application member is mounted on the closure member simplifies the design of the device in so far as it is no longer essential to provide rotary mounting of the application member as was the case with devices of "roll on" type. The application member can therefore be mounted fixedly relative to the closure member, so as to limit the cost of manufacture.

For preference, the application member comes to bear axially against the narrowing of the section of the container when the closure member is in the closed position. This further encourages effective sealing between the narrowing of the section and the application member.

On the application member, a product application surface able to be laden with product may therefore be delimited by a sealed contact between the said application member and the narrowing of the section of the container. The application member thus becomes laden with product in a way that is localized to this application surface, and this subsequently encourages precise application of the product to the surface that is to be treated.

On the application member, the surface which is situated at the periphery of the application surface and which remains unladen with product can be used to spread and/or blend in the product after application.

In one advantageous embodiment, the application surface of the application member has, at least in part, a surface roughness which is different from that of the peripheral surface.

For example, it is possible to provide, for the application surface, a surface finish or roughness that encourages retention of the product and, for the peripheral surface, a surface roughness able to repel the product to prevent it from running It is also possible to provide, for the application surface, a surface roughness that encourages friction for applying the product to the body surface that is to be treated, and, for the peripheral surface, a surface roughness that is slippery so as to avoid excessive adhesion to this bodily surface, notably at the end of application/penetration of the product.

In order to obtain surface roughnesses that are different at least in part, the application member may comprise at least first and second parts which are made from distinct materials and which define these application and peripheral surfaces. Alternatively or in combination, it is also possible for this purpose to provide flocking or reliefs.

For preference, the internal reservoir of the container is delimited axially by the narrowing of the section and by an end wall of said container.

In one particular embodiment, the radial dimension of the application member is greater than that of the access opening.

In order to make the closure member easier to grasp, it may extend at least in part as a projection out of the container when said member is in the closed position.

Advantageously, the device may be used to package cosmetic, pharmaceutical or dermato-pharmaceutical products, notably liquid cosmetic products.

Figure 1:
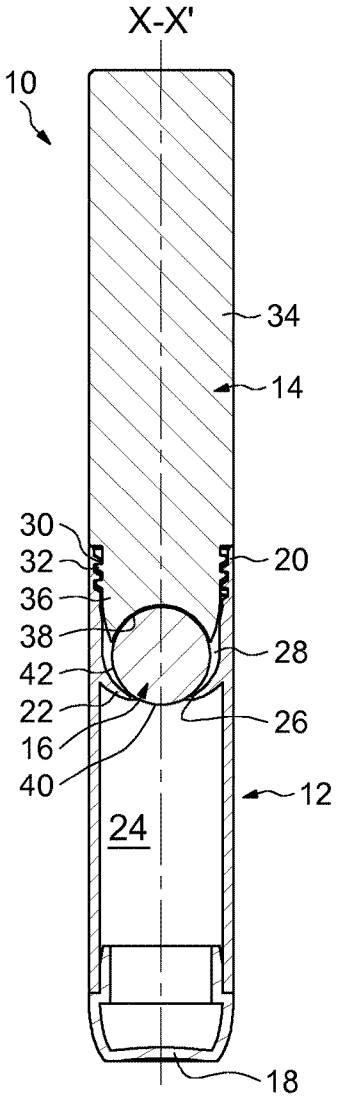
Figure 3:
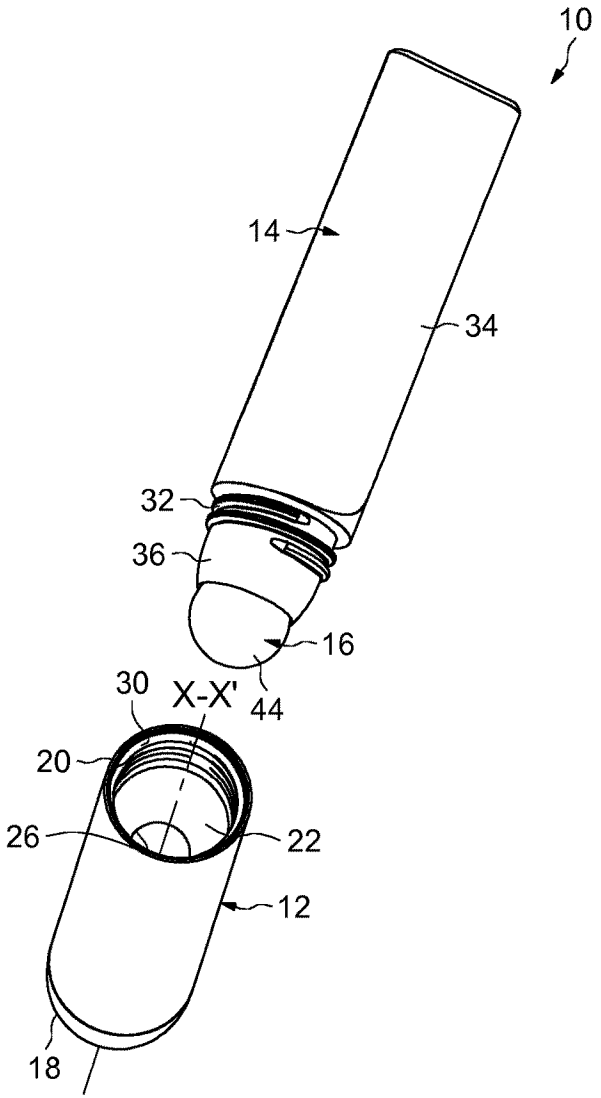

The present invention will be understood better from studying the detailed description of one embodiment that is given by way of entirely non-limiting example and illustrated by the appended drawings, in which:

FIG. 1 is a cross-sectional view of a packaging and application device according to one exemplary embodiment of the invention, FIG. 2 is a cross-sectional view of the device of FIG. 1, on a another plane of section, and FIG. 3 is a perspective view of the device of FIGS. 1 and 2 in an open position.

FIGS. 1 and 2 show a device for packaging and applying a product, denoted by the overall reference numeral 10, which comprises a container 12 for storing the said product (not shown), and a closure member 14 that is fastened removably on the container 12. The closure member 14 bears a product application member 16. The closure member 14 is mounted between a position in which the container 12 is closed, illustrated in FIGS. 1 and 2, and a position in which said container is open, illustrated in FIG. 3.

The storage container 12 extends along a longitudinal, in this case vertical, geometric axis X-X'. The container 12 comprises an end that forms an end wall 18, and an open opposite end that forms a neck 20. In the exemplary embodiment illustrated, the end wall 18 of the container is produced in the form of an attached component so as to allow the container 12 to be filled with product while the closure member 14 is in the closed position. Alternatively, the end wall 18 may be produced as one piece, i.e. as a single entity, with the body of the container.

In the exemplary embodiment illustrated, the container 12 has a circular cross section. As an altern ative, the container 12 may have a cross section that is polygonal, notably square, or alternatively an oval cross section. Alternatively, the container 12 could also be in the form of a tube with a deformable wall.

The container 12 internally comprises a restriction or narrowing of the section 22. The narrower section 22 is situated in the vicinity of the neck 20 of the container. The parts of the container 12 which are situated axially above and below the narrowing of the cross section 22 in this instance have substantially equal internal diameters. As an alternative, it is possible to have different values for these diameters.

In the exemplary embodiment illustrated, the narrowing of the section 22 is formed as one piece with the body of the container 12. The narrowing of the section 22 takes the form of an annular lip which in this instance extends obliquely toward the end wall 18. Alternatively, the narrowing of the section 22 may take the form of a purely radial lip. The container 12 is advantageously obtained by the moulding of a thermoplastic. As an alternative, the container 12 may be equipped with an attached ring on which the narrowing of the section 22 is created. In such an alternative form, the narrowing of the section 22 is also of one piece with the container, i.e. fixed relative to the container 12.

On its inside, the container 12 delimits an internal reservoir 24 for storing the product. The reservoir 24 is delimited axially by the narrowing of the section 22 and by the end wall 18. The narrowing of the section 22 defines an access opening 26 providing access to the reservoir 24. More specifically, the access opening 26 is defined by the internal edge of the narrowing of the section. The opening 26 is the only opening providing access to the reservoir 24. The access opening 26 is centred on the axis X-X'. The access opening 26 here has a cylindrical cross section. As an alternative the access opening 26 may exhibit other shapes, for example conical or polygonal cross section.

That part of the container 12 that is situated axially above the narrowing of the section 22 internally delimits a housing or compartment 28 partially accommodating the closure member 14. The application member 16 is housed inside the compartment 28. The compartment 28 is open axially on the opposite side to the narrowing of the section 22.

As indicated above, the closure member 14 is mounted removably on the container 12. To this end, the neck 20 of the container is provided internally with a helical screw thread 30 collaborating with a complementary screw thread 32 belonging to said closure member. Alternatively, the closure member 14 may be mounted removably on the container 12 by any other appropriate coupling element, for example by snap-fastening, by way of a tight fit, etc.

The closure member 14 extends in part such that it projects axially out of the compartment 28 of the container, and more generally such that it projects axially out of the container 12. The projecting part of the closure member 14 forms a part 34 for grasping.

The closure member 14 also comprises a receiving part 36 for receiving the application member 16, which part axially extends the part 34 for grasping. The receiving part 36 is separated from the part 34 for grasping by an annular shoulder (unreferenced) which comes to bear axially against the end of the neck 20 of the container. The receiving part 36 is externally provided with the screw thread 32. The receiving part 36 engages in a sealed manner in the part of the container 12 that is situated axially above the narrowing of the section 22. The free end of the receiving part 36 comprises a receiving cavity 38 inside which the application member 16 is partially mounted. The closure member 14 is preferably made in one piece by the moulding of a thermoplastic material.

The application member 16 extends so that it partially axially projects out of the cavity 38 of the closure member. When the closure member 14 is in the closed position illustrated in FIGS. 1 and 2, the application member 16 extends inside the compartment 28 of the container and extends through the access opening 26 delimited by the narrowing of the section 22. The application member 16 seals the access opening 26 closed. In other words, there is sealed contact between the application member 16 and the narrowing of the section 22. In the exemplary embodiment illustrated, the application member 16 extends axially beyond the access opening 26, projecting slightly into the reservoir 24.

The application member 16 comes to bear axially against the internal edge of the narrowing of the section 22 of the container. In other words, the application member 16 is pressed axially against the narrowing of the section 22 of the container. That surface of the application member 16 which is situated radially on the inward side of the internal edge of the narrowing of the section 22 defines a product-application surface 40. That surface of the application member 16 which is situated radially on the outward side of this internal edge defines a surface 42 which remains uncoated with product.

The application member 16 is fixed to the closure member 14. As may be seen in FIG. 2, the application member 16 comprises an applicator part 44 on which the surfaces 40, 42 are defined, and a stem 46 extending from the applicator part 44 into a housing 50 of the closure member 14. The stem 46 is provided with a hook 48 so that the application member 16 can be caught and fixed on the closure member 14. The stem 46 of the application member is centred on the axis X-X'. The housing 50 extends all the way from the end wall of the cavity 38. In an alternative form, it is possible to provide an application member 16 comprising only the applicator part 44. The application member 16 may, in that case, be fixed in position by jamming.

In the exemplary embodiment illustrated, the applicator part 44 of the application member has a spherical shape. Alternatively, it is possible to provide other shapes, for example conical, ovoid, etc. Advantageously, the applicator part 44 of the application member 16 is made from a metallic material so as to afford coolness to the application. As an alternative, it is possible to consider other materials, for example a flexible or rigid thermoplastic, or even glass, ceramic, etc.

The device 10 is used in the following manner: When the closure member 14 is in the closed position, the user shakes or inverts the device, notably in order to homogenize the cosmetic product contained in the internal reservoir 24 of the container.

In doing so, the application surface 40 of the application member becomes laden with product. The fact that the opening 26 that provides access to the reservoir 24 of the container is sealed closed by the application member 16 prevents any leakage of product from the reservoir.

After a few shaking or inverting movements, the user detaches the closure member 14 from the container 12. The application member 16 is then outside of the compartment 28 of the container and can be used to deposit the product present on the application surface 40 of the application member on the body surface that is to be treated. The surface 42 of the application member which is not laden with product can then be used to spread and/or blend in the product after application.

In the exemplary embodiment illustrated, the surfaces 40, 42 of the application member are smooth. It is possible to provide reliefs of the rib, stud, boss, fin, etc., type on at least one of these surfaces, so as to encourage the retention of the product on the surface or so as to prevent it from running It is also possible to provide other types of pattern that appear only after first application of the product with a different shade of application member 16. It is also possible to provide complete or partial flocking on the application member 16.

By virtue of the invention, a product packaging and application device is available in which the loading of the application member with product can be performed without the risk of product leaking to the outside. Moreover, application of the product is easier in so far as the application member is held by the removable closure member. The device is suitable for packaging different types of fluid or liquid products, or even products in the form of powders.

The invention claimed is:

1. Device for packaging and applying a product, notably a liquid cosmetic product, comprising a container delimiting an internal reservoir for storing said product, and comprising an access opening providing access to the said reservoir, a closure member mounted removably on the container so as to move between a position in which the said container is closed and an open position, and an application member for applying the product, the closure member bearing the application member and the container internally comprises a narrowing of the section delimiting the access opening providing access to the internal reservoir of the said container, wherein the access opening is formed by an internal edge of the narrowing of the section of the container such that said opening is the only opening providing access to the internal reservoir of the said container, and wherein the application member extends through the access opening and projects into the reservoir, bears against the internal edge of the narrowing of the section, seals the said opening closed and axially faces a bottom end wall of the container when the closure member is in the closed position, the application member being situated outside the container when the closure member is in the open position.

2. Device according to claim 1, wherein the application member comes to bear axially against the narrowing of the section of the container when the closure member is in the closed position.

3. Device according to claim 1, wherein a product application surface and a surface peripheral to said application surface are delimited on the application member by sealed contact between the said application member and the narrowing of the section of the container.

4. Device according to claim 3, wherein the application surface which is situated radially on the inward side of the said sealed contact exhibits at least in part a surface roughness different from that of the peripheral surface which is situated radially on the outward side of said sealed contact.

5. Device according to claim 1, wherein the application member is fixed relative to the closure member.

6. Device according claim 1, wherein the internal reservoir of the container is delimited axially by the narrowing of the section and by an end wall of said container.

7. Device according to claim 1, wherein the narrowing of the section takes the form of an annular lip.

8. Device according to claim 1, wherein the radial dimension of the application member is greater than that of the access opening.

9. Device according to claim 1, wherein the application member has a spherical shape.

10. Device according to claim 1, wherein the closure member extends, at least in part, as a projection out of the container when the said member is in the closed position.

11. Device for packaging and applying a product, notably a liquid cosmetic product, comprising a container delimiting an internal reservoir for storing said product, and comprising an access opening providing access to the said reservoir, a closure member mounted removably on the container so as to move between a position in which the said container is closed and an open position, and an application member for applying the product, the closure member bearing the application member, and the container internally comprises a narrowing of the section delimiting the access opening providing access to the internal reservoir of the said container, wherein the application member extends through the access opening and projects into the reservoir, seals the said opening closed and axially faces a bottom end wall of the container when the closure member is in the closed position, the application member being situated outside the container when the closure member is in the open position, and wherein the application member is fixed on the closure member without freedom to rotate on itself.

12. Device for packaging and applying a product, notably a liquid cosmetic product, comprising a container delimiting an internal reservoir for storing said product, and comprising an access opening providing access to the said reservoir, a closure member mounted removably on the container so as to move between a position in which the said container is closed and an open position, and an application member for applying the product, the closure member bearing the application member, and the container internally comprises a narrowing of the section delimiting the access opening providing access to the internal reservoir of the said container, wherein the application member extends through the access opening and projects into the reservoir, seals the said opening closed when the closure member is in the closed position, the application member being situated outside the container when the closure member is in the open position, wherein the application member is made of rigid material, and wherein the closure member is provided with coupling element cooperating with the container to be mounted removably on the container, the application member being fixed directly on the closure member without freedom to rotate on itself.

* * * * *